United States Patent [19]

Erickson

[11] 4,090,729

[45] May 23, 1978

[54] BOTTLE CARRIER

[75] Inventor: Gerald Erickson, Palm Beach, Fla.

[73] Assignee: International Omni-Pak Corporation, Palm Beach, Fla.

[21] Appl. No.: 782,770

[22] Filed: Mar. 30, 1977

[51] Int. Cl.[2] ..... B65D 23/10

[52] U.S. Cl. ..... 294/31.2; 215/100 A; 224/45 AA

[58] Field of Search ..... 294/31.2, 87.2, 87.28, 294/90; D9/176, 178; 206/144, 145, 150, 151, 162, 163, 192, 194; 215/100 R, 100 A; 220/85 H, 94 R; 224/45 A, 45 AA, 45 AB, 45 BA, 45 P, 45 Q

[56] References Cited

U.S. PATENT DOCUMENTS

| | | | |
|---|---|---|---|
| D. 237,466 | 11/1975 | Calvert | D9/178 |
| D. 238,657 | 2/1976 | Erickson | D9/178 |
| 3,036,853 | 5/1962 | Glazer | 294/87.2 |
| 3,155,263 | 11/1964 | Hidding | 215/100 A |
| 3,311,252 | 3/1967 | Swartwood et al. | 294/31.2 X |
| 3,463,536 | 8/1969 | Updegraff et al. | 294/31.2 |
| 3,633,962 | 1/1972 | Erickson | 294/87.28 X |

*Primary Examiner*—Johnny D. Cherry
*Attorney, Agent, or Firm*—Brumbaugh, Graves, Donohue & Raymond

[57] ABSTRACT

An integrally formed bottle carrier for carrying a single bottle by the neck including a frame having an opening therein, a split collar within the opening for receiving the neck of the bottle, bridging members connecting the split collar and the ends thereof to the frame to support the split collar within the opening and permit spreading of the split ends to facilitate the insertion and removal of the neck of the bottle and a handle connected to the frame for transporting the bottle in the carrier.

8 Claims, 3 Drawing Figures

FIG. 1
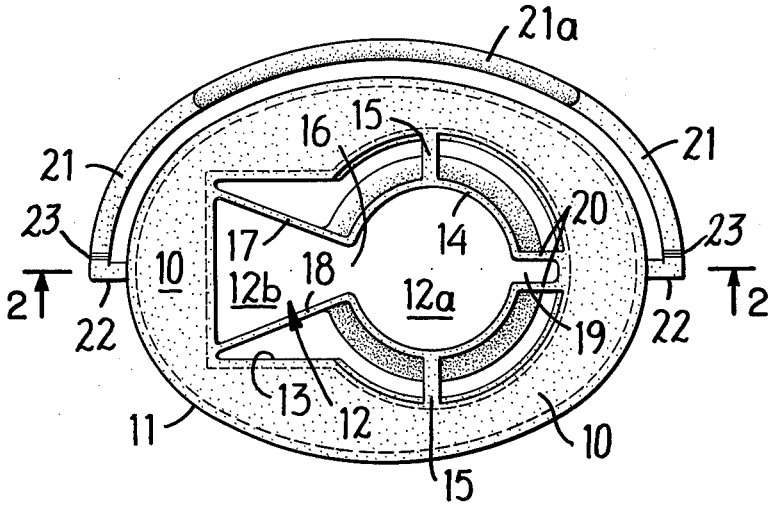
FIG. 2
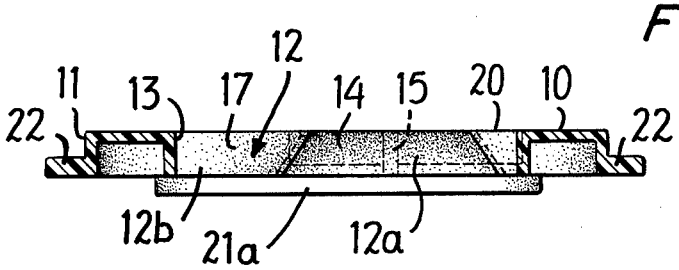
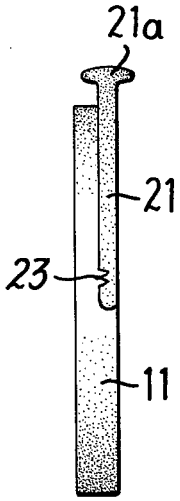
FIG. 3

BOTTLE CARRIER

This invention relates to an integrally formed bottle carrier of the type shown and described in my U.S. Pat. No. 3,633,962, issued Jan. 11, 1972, and more particularly to a novel bottle carrier for carrying a single bottle.

The single bottle carrier of the present invention makes it possible for the consumer to easily tote a single large, heavy bottle, for example, a half gallon or gallon size, and thus take advantage of an economy that the customer might otherwise miss. The bottle carrier of the present invention is capable of ready application to a bottle at the bottling location or in a retail store. When the bottle is locked within the bottle carrier it can be readily handled without danger that the bottle will be accidentally released from the carrier.

For a complete understanding of the present invention, reference can be made to the detailed description which follows and to the accompanying drawings in which:

FIG. 1 is a plan view of the bottle carrier of the present invention;

FIG. 2 is a sectional view taken along the line 2—2 of FIG. 1 looking in the direction of the arrows; and FIG. 3 is a side elevational view.

Referring to the bottle carrier shown in FIGS. 1 through 3 of the drawings, the bottle carrier includes a web 10 having a flat upper surface, a depending reinforcing flange 11 around the outer periphery of the web, an opening 12 in the web defined by a depending reinforcing flange 13, a split collar 14 within the opening for receiving the neck of a bottle and bridging connections 15 connecting the outer surface of the split collar to the depending flange 13. The web 10 is a relatively thin and flat member having a flat upper surface to provide an imprint area so that a trademark, advertising matter or instructions for using the carrier can be imprinted, molded or otherwise formed on the flat upper surface thereof.

The split collar 14 is a tapered conical section larger at the bottom than at the top to facilitate the insertion of the neck of the bottle therein from the bottom. Each collar is split to provide an opening 16 between the split ends, and the split ends are connected to the depending flange 13 by a pair of diagonal bridging struts 17 and 18 which taper away from each other in the direction from the split ends to the portions of the depending flange 13 to which they are connected. The angular relationship of the diagonal struts 17 and 18 permits the split collar to be forced open to increase the size of the opening while at the same time to provide support for the ends of the split collar to prevent them from sagging under the weight of the bottle and to offer resistance to accidental spreading of the split ends when the split collar is supporting a bottle therein.

The collar is also split at the opposite end to provide an opening 19 directly opposite the opening 16. This split end is connected to the depending flange 13 by bridging connections 20 which cooperate with the depending flange 13 to form a yolk which serves as a pivot for the two components of the collar on opposite sides of the section line 2—2 of FIG. 1, thereby facilitating the spreading of the open end of the collar for the insertion and removal of a bottle.

The opening 12 defined by the depending flange 13 includes a substantially circular shaped portion **12*a* which accommodates the split collar and a keyhole extension portion 12*b* which accommodates the diagonal struts 17 and 18**.

The shape of the one-bottle carrier defined by the outer depending flange 11 is generally of an oval or elliptical shape as shown in FIG. 1, but the bottle carrier as defined by the outer depending flange can be of rectangular, square, circular or other desired shape.

The bottle carrier of the present invention has a handle 21 which initially lies substantially in the plane of the bottle carrier. The portion **21*a*** of the handle intermediate its ends is preferably flattened or made wider to increase the surface of the handle gripped by the fingers.

The handle is connected to diametrically opposite posts 22 which extend outwardly from the outer surface of the depending flange 11, and the handle will bend upwardly under the weight of the bottle so that in carrying position it extends longitudinally across the top of the bottle with the longitudinal orientation thereof being parallel to the longitudinal orientation of the extension **12*b* of the opening. In this manner the handle can be used to facilitate the separation of the bottle from the carrier when the handle is held in one hand and the lower end of the bottle is pivoted away from the extension 12*b* of the opening in the bottle carrier, thereby forcing the neck of the bottle into the extension 12*b*** to remove it from the bottle carrier.

The carrier is preferably made of a resilient plastic material, such as polypropylene, and the upper surface of the handles contains notches or recesses 23 adjacent the posts 22 to facilitate bending into carrying position.

The invention has been shown and described in preferred form and by way of example only, and different variations and modifications can be made therein within the spirit of the invention. The invention, therefore, is not intended to be limited to any particular form or embodiment except in so far as such limitations are expressly set forth in the claims.

I claim:

1. A bottle carrier for carrying a single bottle from the neck comprising a frame having an opening therein, a split collar within the opening for receiving the neck of a bottle, the split collar being tapered inwardly from the lower edge toward the upper edge to facilitate the insertion of the neck of the bottle, bridging means connecting the outer tapered surface of the split collar to the frame defining the opening in order to support the split collar within the opening and permit spreading of the split ends to facilitate the insertion and removal of the neck of a bottle, said frame being longer in one direction than another to define diametrically opposite outwardly extending ends of said frame for toting the bottle carrier, an inner reinforcing portion of the frame around said opening, an outer reinforcing portion of the frame around the inner reinforcing portion for toting the bottle carrier and means connecting the inner and outer frame portions.

2. A bottle carrier as set forth in claim 1 in which said means connecting the inner and outer frame portions includes a web having a flat upper surface.

3. A bottle carrier as set forth in claim 1 including a handle connected to the outer edges of said diametrically opposite ends of said frame, an oval web surrounding said inner reinforcing frame portion, said inner frame portion depending downwardly from the inner edge of the web and defining the opening, and said outer reinforcing frame portion depending downwardly at the outer edge of said web, the said split collar being oriented so that it faces in the direction of one of the enlongated ends of the oval, and in which the handle initially lies in substantially the same plane as the bottle carrier and is connected at opposite ends to the outer reinforcing frame portion across the long dimension of the oval so that it will be pivoted to upright position under the weight of the bottle.

4. A bottle carrier for carrying a single bottle from the neck comprising a frame having an opening therein, a split collar within the opening for receiving the neck of a bottle, the split collar being tapered inwardly from the lower edge toward the upper edge to facilitate the insertion of the neck of the bottle, bridging means connecting the outer tapered surface of the split collar to the frame defining the opening in order to support the split collar within the opening and permit spreading of the split ends to facilitate the insertion and removal of the neck of a bottle, said frame including a web having a flat upper surface, an inner depending reinforcing flange around the said opening, and a depending reinforcing flange around the outer periphery of said web, a handle connected to the frame for toting the bottle carrier in which the handle initially lies in substantially the same plane as the reinforcing flange around the outer periphery of the web and a pair of posts connecting opposite ends of the handle to diametrically opposite portions of the outer edge of the reinforcing flange around the outer periphery of the web.

5. A bottle carrier as set forth in claim 4 in which the opening in the web includes a substantially circular shaped portion accommodating the split collar and bridging means therefor and an extension portion to the circular shaped opening and including bridging connections between the ends of the split collar and the inner reinforcing flange which defines the opening and in which said bridging connections include diagonal bridging struts extending from the ends of the split collar outwardly to the edge of said inner depending reinforcing flange defining said extension portion of the opening.

6. A bottle carrier as set forth in claim 5 in which said posts extend from diametrically opposite edges of the reinforcing depending flange around the outer periphery of the web, said handle bending upwardly under the weight of the bottle so that in carrying position it extends longitudinally across the top of the bottle with the longitudinal orientation thereof parallel to the longitudinal orientation of the extension portion of the opening.

7. A bottle carrier as set forth in claim 6 in which the handle is flattened intermediate its ends to increase the gripping surface thereof.

8. A bottle carrier as set forth in claim 4 in which said pair of posts is integrally formed with and extends outwardly from the opposite sides of the reinforcing flange around the outer periphery of said web, and recessed means formed in the upper surface of said handle adjacent said posts to facilitate the pivotal movement of said handle to an upright position relative to the web of said carrier.

* * * * *